US005910361A

United States Patent [19]

Guevel et al.

[11] Patent Number: 5,910,361

[45] Date of Patent: Jun. 8, 1999

[54] HYBRID YARN FOR COMPOSITE MATERIALS WITH THERMOPLASTIC MATRIX AND METHOD FOR OBTAINING SAME

[75] Inventors: Jean Guevel, Viriat; Marc Francois, Charbonnieres les Bains; Guy Bontemps, Tenay, all of France

[73] Assignee: SA Schappe, Charnoz, France

[21] Appl. No.: 07/730,199

[22] Filed: Jul. 15, 1991

[30] Foreign Application Priority Data

Jul. 13, 1990 [FR] France ..... 90 09398

[51] Int. Cl.[6] ..... D02G 3/06; D02G 3/02

[52] U.S. Cl. ..... 428/364; 428/367; 428/377; 428/375; 428/394; 428/392; 428/395; 57/210; 57/224; 57/229; 57/243; 57/244; 57/249; 57/252; 57/255; 264/210.1; 264/210.7; 264/210.8

[58] Field of Search ..... 428/359, 364, 428/373, 374, 377, 367, 392, 394, 395, 375; 57/243, 252, 255, 244, 249, 210; 264/210.1, 210.7, 210.8

[56] References Cited

U.S. PATENT DOCUMENTS

| | | | |
|---|---|---|---|
| 3,007,227 | 11/1961 | Moler | 428/359 |
| 3,631,667 | 1/1972 | Marzocchi . | |
| 3,681,910 | 8/1972 | Reese | 428/373 |
| 4,356,690 | 11/1982 | Minorikawa et al. | 428/359 |
| 4,502,364 | 3/1985 | Zucker et al. | 428/374 |
| 4,800,113 | 1/1989 | O'Connor | 428/374 |
| 4,925,729 | 5/1990 | O'Connor | 428/374 |
| 5,011,523 | 4/1991 | Roncato et al. | 428/374 |

FOREIGN PATENT DOCUMENTS

| | | | |
|---|---|---|---|
| 0 156 600 | 10/1985 | European Pat. Off. . | |
| 0 351 201 | 3/1990 | European Pat. Off. . | |
| 0 354 139 | 6/1990 | European Pat. Off. . | |
| 2 634 790 | 2/1990 | France . | |
| 2407 357 A1 | 8/1975 | Germany . | |
| 616964 | 4/1980 | Germany | 428/373 |
| 1292128 | 11/1989 | Japan | 428/373 |

OTHER PUBLICATIONS

1236 Melliand Textilberichte/International Textile Reports 67 (1986) Nov., No. 11, Heidelberg, W. Germany.

*Primary Examiner*—William Krynski
*Assistant Examiner*—J. M. Gray
*Attorney, Agent, or Firm*—Oliff & Berridge, PLC

[57] ABSTRACT

A hybrid yarn is made up of an intimate mixture of spun yarns of reinforcing fibers and spun yarns of thermoplastic matrix fibers. The spun yarns are obtained by cracking with slow, gradual stretching of the multifilaments. After stretching, parallel fibers are wrapped with a continuous thermoplastic filament. The invention may be used to produce hot-stamped parts.

7 Claims, 2 Drawing Sheets

HYBRID YARN FOR COMPOSITE MATERIALS WITH THERMOPLASTIC MATRIX AND METHOD FOR OBTAINING SAME

BACKGROUND OF THE INVENTION

The present invention relates to a hybrid yarn for composite materials with thermoplastic matrices, composed of thermoplastic fibers, as well as the method for obtaining same.

In current processes used to manufacture these types of composite materials, reinforcing fibers (carbon, aramide, or glass) in multifilament form are woven alternately with multifilaments of thermoplastic matrix fibers.

These thermoplastic matrix fibers belong to the classical families:

polyether ether ketone (PEEK), phenylene polysulfide (PPS), polyether imide (PEI), polyether sulfone (PES), polyamide.

This manufacturing technique has numerous drawbacks, including:

poor wettability, a large open-space ratio, delamination of the reinforcing fibers.

Another technique consists of commingling the multifilament of reinforcing fibers with the multifilament of thermoplastic fibers by a method known as "Commingled."

There are also other methods, which consist of filling the reinforcing fibers with a powdered thermoplastic matrix, the outside of which has a molten sheath containing the powder. There are also solvent impregnation processes, which have implementation problems, particularly in terms of worker safety and environmental impact. Inclusion of residual solvents in the composite is also prejudicial to good flame resistance.

These techniques all have substantial drawbacks in several areas:

cost of making the yarn, difficulties in weaving or braiding, difficulties in weaving or braiding, impossibility of making intricate fibrous parts since the network of continuous reinforcing fibers is nondeformable.

Applicant's French Patent 2,634,790 teaches making a hybrid yarn for composite materials with a thermoplastic matrix by intimate mingling of reinforcing fibers and thermoplastic matrix fibers which have previously and independently undergone a cracking operation with slow, gradual stretching of the multifilaments.

The final strip obtained is then subjected to the classical spinning operations for long fibers: passage through a roving frame, spinning, winding, joining, and twisting.

The spun yarns thus obtained are able to be transformed by weaving, knitting, or braiding, to obtain composite materials having numerous advantages over materials of the same type obtained by methods of the prior art.

These advantages are the following:

very good wettability of the reinforcing fibers, very low open-space ratio, drapability of the textile surfaces allowing molding of developable or nondevelopable surfaces, highly isotropic material in the direction of the reinforcing fibers, excellent resistance to delamination. In fact, the material looks like a monolithic solid which has "forgotten" its original stratified structure.

The composite obtained may also be easily hot stamped.

DE-A-2,407,357 describes a yarn intended for garment fabrics obtained from a bundle of plant or animal fibers (cotton, wool) intimately mingled with polyester or polyamide. The wrapping technique of spinning is used in order to substantially improve the rate of production. This yarn has a wrapping filament which is of the same nature as the synthetic fiber in the mixture for dyeing affinity purposes. This wrapping filament, which is an integral part of the yarn and remains present in the final garment, also confers dimensional stability to the garment and reduces wrinkling of the fabric.

SUMMARY OF THE INVENTION

A goal of the invention is to provide a hybrid yarn having all the properties of the yarn in FR-A-2,634,790 and additionally having excellent deformability allowing hot-stamped portions with deep shapes to be produced without breakage and without formation of folds which are prejudicial to the homogeneity of such portions.

The hybrid yarn of the invention comprises an intimate blend of spun yarns of reinforcing fibers and of thermoplastic matrix fibers, all of the spun yarns having been obtained by cracking. The cracking step involves slow, gradual stretching of multifilaments, and is characterized in that, after stretching, the parallel fibers are wrapped by a continuous thermoplastic filament.

The structure of the yarn according to the invention allows a bundle of very-high-modulus organic or inorganic fibers to be used to form a yarn in which each fibrous element remains straight, thus avoiding twisting that would bring about internal stresses in the fibers. Moreover, the use of a filament of thermoplastic fiber for wrapping ensures cohesion of the yarn during transformation of the yarn into a textile surface, by weaving or knitting for example. During transformation of the textile surface into a composite, the wrapping filament as well as the thermoplastic fibers of the core melt, release the mass of high-modulus fibers which constitutes a reinforcement completely free of any constraint. The final composite contains only a network of these reinforcing fibers embedded in the molten organic material. Hence, no trace of wrapping filament is found in the final composite.

It should be noted that in the yarn of the invention the fibers are treated by cracking, while in traditional techniques the organic fibers undergo a cutting operation.

Advantageously, the continuous filament of thermoplastic material used for wrapping is of the same kind as the fibers of thermoplastic material, and represents between 10 and 25% of the total volume of the thermoplastic material contained in the yarn.

According to another characteristic, this yarn has 50 to 55% reinforcing fibers and 50 to 45% thermoplastic fibers.

The reinforcing fibers are chosen from carbon, aramide, or glass fibers while the thermoplastic fibers are chosen from polyether ether ketone (PEEK), phenylene polysulfide (PPS), polyether sulfone (PES), polyetherimide (PEI), as well as other fibers known to be used for the purpose such as polyamides and polyimides.

The deformability of a composite material obtained from this yarn is excellent, in view of the outstanding ability of the reinforcing fibers to slide past each other during molding, i.e. when the thermoplastic fibers have melted.

This advantage results from the discontinuity of the reinforcing fibers and the fact that they are not bound together by twisting the original yarn. These deformability properties are obtained without damaging the other properties, particularly the mechanical properties.

Such a yarn is hence particularly suitable for making complex parts in the fields of industry, automobiles, and aeronautics, and particularly for upholstering the interiors of aircraft and helicopter cabins.

One method of obtaining this hybrid yarn consists of first subjecting multifilaments of reinforcing fibers and multifilaments of matrix fibers to separate processes of cracking by slow, gradual stretching, assembling strips of the discontinuous fibers so obtained on a stretching machine of the intersecting type, the strip leaving this stretching machine being combined on another stretching machine with identical strips, this operation being repeated several times in order to obtain the most intimate mixture possible, subjecting the strip thus obtained to stretching in a laminating machine, and finally passing the bundle of mingled, parallel discontinuous fibers through a hollow spindle carrying a continuous thermoplastic filament to wrap the bundle of fibers with the continuous filament.

In view of the low cohesion of the fibers, lamination is effected in one zone with the fibers resting on a single apron, with a stretching ratio less than 50 and a travel speed reduced by 50% from the values used to transform organic fibers.

BRIEF DESCRIPTION OF THE DRAWINGS

The invention will be better understood with reference to the drawings, wherein.

DETAILED DESCRIPTION OF PREFERRED EMBODIMENTS

Figure 1:
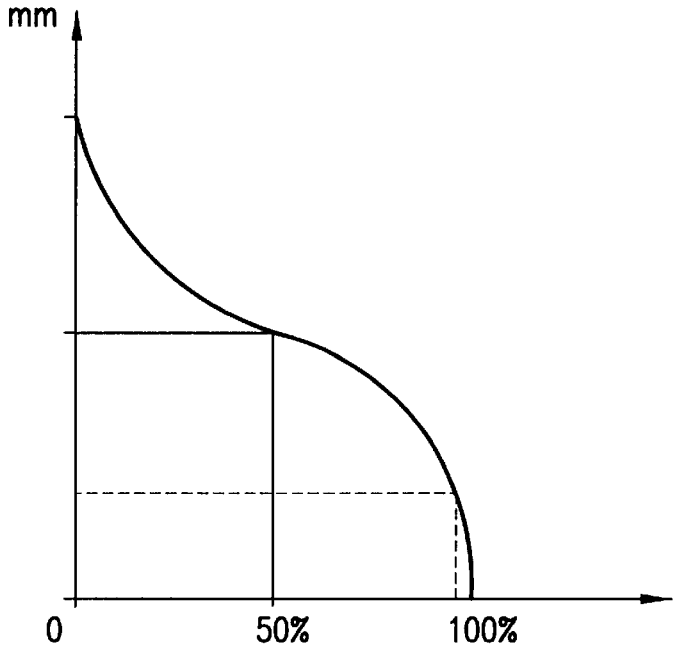
FIG. 1 is a graph of lengths of fibers that have undergone the cracking operation against the fiber population.

The yarn according to the invention contains reinforcing fibers designated by reference numeral 2, and thermoplastic matrix fibers designated by reference numeral 3.

Figure 2:
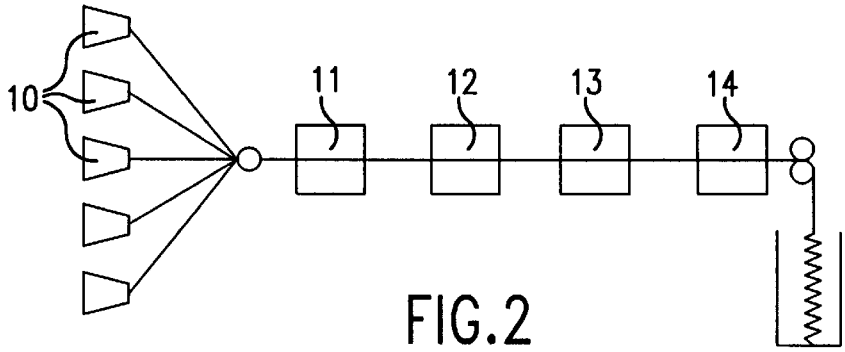
FIG. 2 is a schematic view of the fiber cracking machine.

Multifilaments of matrix fibers are subjected to a cracking operation with the aid of the machine shown in FIG. 2. Multifilaments of reinforcing fibers are also subjected to a cracking operation with the aid of a machine of the same type. This machine, shown in FIG. 2, has bobbins 10 for supplying cabled multifilaments. These cables are then subjected to a cracking operation by controlled stretching and breaking, by successive passages into zones 11, 12, 13, and 14, with the speeds of stretching zones 11, 12 and of cracking zones 13, 14 increasing gradually from zone 11 to zone 14, producing a strip of discontinuous fibers having a completely controlled average length. This length is illustrated in the graph of FIG. 1 which shows the fiber length in millimeters on the ordinate and the population of fibers, expressed as a percentage of the number of fibers in this population, on the abscissa. Machines different in type from those shown in FIG. 2 are used to obtain, on the one hand, strips of discontinuous reinforcing fibers 2 and, on the other hand, strips of discontinuous thermoplastic matrix fibers 3.

Figure 3:
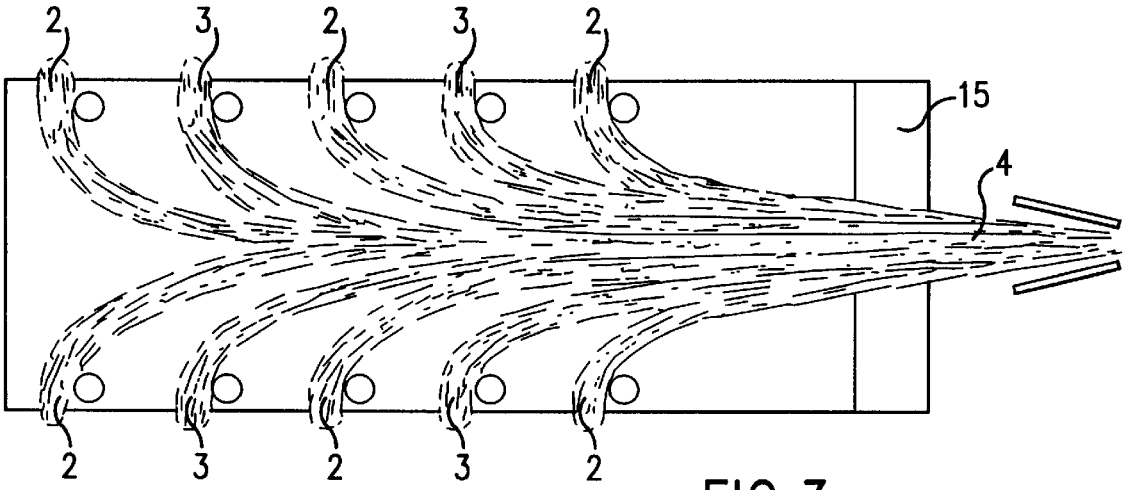
FIG. 3 is a schematic view of a machine for mingling cracked fibers leading to a strip of spun yarns of hybrid fibers according to the invention.

These strips 2 and 3 are then brought by means known of themselves to a mingling device shown in FIG. 3. This device consists of a machine having a stretching zone 15 of the intersecting type which produces an inhomogeneous strip 4 of reinforcing fibers 2 and matrix fibers 3 which has "traces" of each of the components.

Each strip 4 thus obtained is then assembled on a similar machine with ten other identical strips. This operation is repeated several times, preferably four times, thus producing spun yarns of hybrid fibers in the desired final proportions of reinforcing fibers and thermoplastic fibers. These proportions vary according to the characteristics of the thermoplastic matrix fibers, particularly viscosity when the fibers are hot. However, the proportions of reinforcing fibers and thermoplastic matrix fibers are about 53% and about 47%, respectively.

Figure 4:
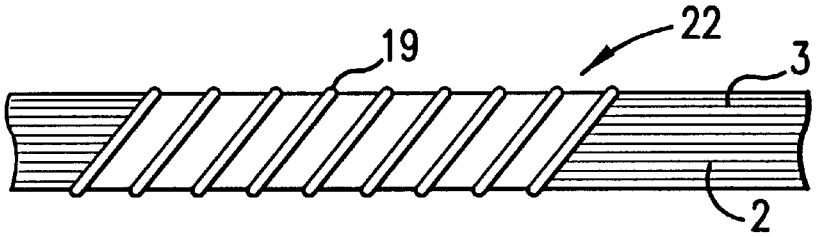
FIG. 4 is a schematic view of the structure of the yarn according to the invention.
Figure 5:
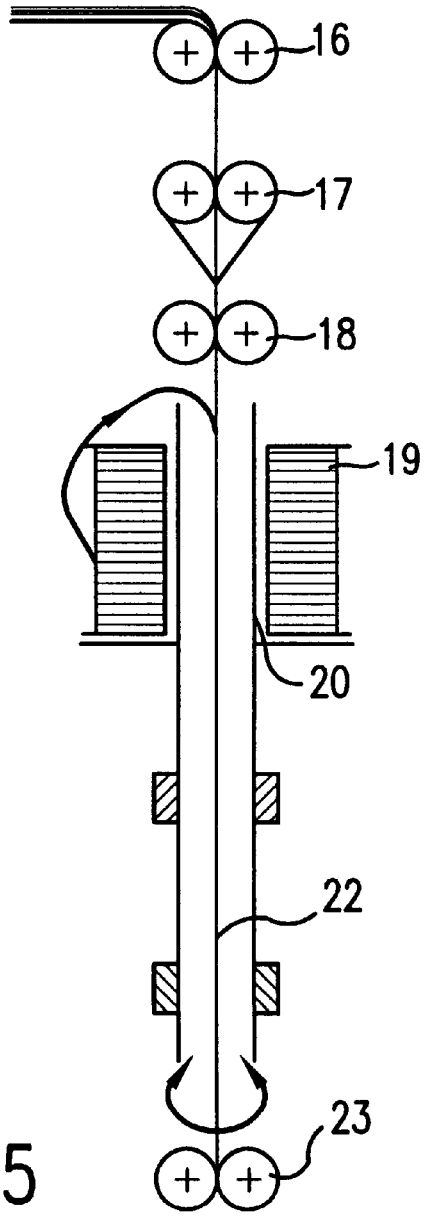
FIG. 5 is a view of the spinning device.

The strip obtained is then subjected to a spinning operation known as wrapping spinning on a long-fiber laminating system as shown in FIG. 5. The reinforcing and matrix fibers, intimately mingled, are subjected to stretching in a conventional laminating system 16, 17 of the S.K.F. or Suessen type. At the delivery point 18, the parallel fibers are wrapped by a continuous multifilament 19 of the same nature as the matrix fiber used. Filament 19 is carried by a hollow spindle 20 inside which passes the bundle of parallel, mingled, discontinuous fibers, which bundle is wrapped by the resin filament. The complete wrapped yarn 22 is then picked up by receiving rolls 23. The structure of the wrapped yarn is shown in FIG. 4.

Under these conditions, a perfectly straight network of discontinuous reinforcing and matrix fibers is produced. This yarn has a very important advantage over the basic twisted-yarn spinning technique. In the latter technique, the fibers are deformed into helices, and are thus subject to a composite shear and pulling stress which substantially alters the mechanical properties of the composites obtained.

The spun yarns according to the invention can be transformed by weaving, knitting, or braiding into composite materials having excellent wettability characteristics, a very low open-space ratio, very good isotropy in the direction of the reinforcing fibers, excellent resistance to delamination, and excellent deformability, due to the sliding of the reinforcing fibers over each other, after softening of the thermoplastic fibers.

EXAMPLES

Table I compares the properties of various composite materials made from a mixture of carbon-based reinforcing fibers, and thermoplastic matrix fibers based on phenylene polysulfide (PPS).

The samples numbered 1 to 6 belong to the family of discontinuous-reinforcement composites, formed by the cracked, twisted long-fiber technique. The Sampe and composite No. 3 references correspond to the continuous commingled yarn technique.

This table shows the existence of slight differences in the fiber ratios. The densities are also very similar. However, there is a very low open-space ratio for the hybrid yarn according to the invention showing that the composite obtained is highly homogeneous. The mechanical characteristics of the yarn according to the invention are very close to those of the other yarns, both in terms of modulus and breaking stress during bending or pulling. However, the deformability tests show a very distinct advantage for the yarn according to the invention over yarns manufactured by prior art techniques.

As can be seen from the foregoing, the invention provides a great improvement to existing technology by furnishing a hybrid yarn having not only excellent mechanical characteristics but also excellent deformability.

Of course, the invention is not confined to the yarn compositions described above in the examples; on the contrary, it covers all variants thereof.

TABLE I

| Sample Number | Yarn Ratio (Volume %) | Density (g/cm2) | Open Space Ratio % | BENDING BS* (GPa) | BENDING MS** (GPa) | BS* Shear (MPa) | PULLING BS* (GPa) | PULLING MS** (GPa) |
|---|---|---|---|---|---|---|---|---|
| 1 | 56 | 1.60 | 1.2 | 0.94 | 53.5 | — | — | — |
| 2 | 56.7 | 1.60 | 0.9 | 0.86 | 65.4 | — | — | — |
| 3 | 58.2 | 1.61 | 0.1 | — | — | 57.3 | — | — |
| 4 | 56 | 1.60 | 0.4 | — | 59.3 | — | — | |
| 5 | 56.7 | 1.62 | 0.9 | — | — | — | 0.96 | 44.7 |
| 6 | 58.9 | 1.62 | 0.9 | — | — | — | 0.89 | 44.7 |
| SAMPE, Jal | 51 | 1.54 | 1.6 | 1.19 | 91.6 | — | 1.43 | 120.6 |
| Jan–Feb 88 pp. 8–10 | 53 | 1.58 | 0.5 | 1.34 | 99.9 | — | 1.59 | 122.6 |
| Composite N° 3 May June 1986 pp. 121–128 | 56 | — | — | 1.4 | 126 | — | 1.2 | — |
| Hybrid Yarn According to The Invention | 53 | 1.58 | 0.5 | 1.20 | 95 | 65 | 1.35 | 110 |

*BK = Breaking Stress
**MS = Modulus

What is claimed is:

1. A hybrid yarn for composite materials with a thermoplastic matrix, comprising an intimate mixture, of spun yarns of reinforcing fibers and spun yarns of thermoplastic matrix fibers, each of the spun yarns of fibers having been obtained by cracking with slow, gradual stretching of multifilaments, and, after stretching, parallel fibers of said mixture, having been wrapped by a continuous filament of thermoplastic material.

2. A hybrid yarn according to claim 1, wherein the continuous filament of thermoplastic material used for wrapping is of the same nature as the thermoplastic matrix fibers.

3. A hybrid yarn according to claim 1, wherein the wrapping thermoplastic filament represents between 10 and 25% of the total volume of thermoplastic material contained in the yarn.

4. A hybrid yarn according to claim 1, comprising 50 to 55% of said reinforcing fibers and 50 to 45% of said thermoplastic fibers.

5. A hybrid yarn according to claim 1, wherein said reinforcing fibers are selected from the group consisting of carbon, aramide, and glass fibers.

6. A hybrid yarn according to claim 1, wherein the thermoplastic matrix fibers are composed of a material selected from the group consisting of polyether ether ketone (PEEK), phenylene polysulfide (PPS), polyether sulfone (PES), polyetherimide (PEI), polyamides and polyimides.

7. A method for obtaining a hybrid yarn for composite materials with a thermoplastic matrix, comprising subjecting multifilaments of reinforcing fibers and multifilaments of matrix fibers to separate processes of cracking by slow, gradual stretching, assembling the resulting strips of discontinuous fibers thus obtained on a stretching machine of the intersecting type, a stretched strip leaving this stretching machine being assembled on another stretching machine with identical strips, this operation being repeated several times in order to obtain a highly intimate mixture, subjecting the strip obtained to stretching in a laminating system, and finally passing the resulting bundle of parallel, mixed, discontinuous fibers through a hollow spindle bearing a continuous filament of thermoplastic material to wrap the bundle of fibers with said continuous filament.

* * * * *